US009540214B2

(12) United States Patent
Bloch

(10) Patent No.: US 9,540,214 B2
(45) Date of Patent: Jan. 10, 2017

(54) ELEVATOR SYSTEM HAVING A CAR-SIDE EXTINGUISHING WATER DRAIN SYSTEM

(75) Inventor: Hanspeter Bloch, Buchrain (CH)

(73) Assignee: Inventio AG, Hergiswil (CH)

( * ) Notice: Subject to any disclaimer, the term of this patent is extended or adjusted under 35 U.S.C. 154(b) by 792 days.

(21) Appl. No.: 13/517,438

(22) PCT Filed: Dec. 17, 2010

(86) PCT No.: PCT/EP2010/070129
§ 371 (c)(1),
(2), (4) Date: Jun. 20, 2012

(87) PCT Pub. No.: WO2011/085911
PCT Pub. Date: Jul. 21, 2011

(65) Prior Publication Data

US 2012/0255816 A1 Oct. 11, 2012

(30) Foreign Application Priority Data

Dec. 21, 2009 (EP) ..... 09180218

(51) Int. Cl.
*B66B 11/02* (2006.01)
*B66B 13/30* (2006.01)

(52) U.S. Cl.
CPC ..... *B66B 11/0226* (2013.01); *B66B 13/301* (2013.01)

(58) Field of Classification Search
CPC ..... B66B 11/0226; B66B 13/301
USPC ..... 187/401
See application file for complete search history.

(56) References Cited

U.S. PATENT DOCUMENTS

| | | | | |
|---|---|---|---|---|
| 6,047,792 | A * | 4/2000 | Jin et al. | 187/401 |
| 7,594,355 | B1 * | 9/2009 | Aagaard | 47/1.01 R |
| 2009/0302132 | A1 * | 12/2009 | Hartley | 239/289 |
| 2010/0116597 | A1 * | 5/2010 | Matsuda | B66B 11/028 187/401 |
| 2010/0276008 | A1 * | 11/2010 | Abrams | 137/68.14 |
| 2013/0098713 | A1 * | 4/2013 | Urben et al. | 187/401 |

FOREIGN PATENT DOCUMENTS

| | | | | |
|---|---|---|---|---|
| GB | 2 280 662 | A | 2/1995 | |
| JP | 5178568 | A * | 7/1993 | B66B 11/02 |
| JP | 2002-362869 | A | 12/2002 | |
| JP | 2004-115251 | A | 4/2004 | |
| JP | 2005082271 | A * | 3/2005 | |
| WO | 98/22381 | A | 5/1998 | |

OTHER PUBLICATIONS

Machine Translation of JP 2004-115251.*
Machine Translation of Abstract of JP 2005-082271 A.*

* cited by examiner

*Primary Examiner* — William E Dondero
*Assistant Examiner* — Diem Tran
(74) *Attorney, Agent, or Firm* — Fraser Clemens Martin & Miller LLC; William J. Clemens

(57) ABSTRACT

A drain system, in an elevator system having at least one elevator car with an upper edge running approximately parallel to a horizontal plane, includes a deflector plate arranged on the upper edge of the elevator car at at least one angle of inclination to the horizontal plane and inclined against a shaft wall in which shaft doors are arranged, so that extinguishing water, which falls onto the elevator car is directed at least partially from the deflector plate against the upper edge and against the shaft wall in which the shaft doors are arranged.

14 Claims, 5 Drawing Sheets

ELEVATOR SYSTEM HAVING A CAR-SIDE EXTINGUISHING WATER DRAIN SYSTEM

FIELD

The present invention relates to an elevator installation in which at least one elevator car or at least one car and at least one counterweight are moved in opposite directions in an elevator shaft, wherein the at least one elevator car and the at least one counterweight run along guide rails, are supported by one or more supporting and driving means and are driven via a driving pulley of a drive unit. The present invention relates to a drainage system for extinguishing water and, in particular, to the configuration of the elevator car.

BACKGROUND

Modern elevator installations or so-called firefighters' elevators designed specifically therefor have to ensure reliable operation even in the event of a fire, on the one hand in order for individuals or at-risk material to be evacuated from the floors affected by the fire, but on the other hand also for transporting the firefighters and their extinguishing equipment. In both cases, the use of extinguishing water—whether by means of a sprinkler installation or on the part of the fire department or both—must not result in the elevator installation or the firefighters' elevator no longer functioning.

This means that the electrical components of the elevator installation have to remain dry. Furthermore, the supporting and driving means must not become so wet as to result in uncontrollable slippage between the driving pulley and the supporting and driving means. Slippage can occur particularly easily because the extinguishing water can have a direct adverse effect on the coefficients of friction between the driving pulley and the supporting and driving means, and/or can change the viscosity of any lubricants, and, on the other hand, it usually contains soap for better firefighting purposes.

The slippage occurring between the driving pulley and supporting and driving means thus gives rise to a reduction in traction or even to a complete loss of traction of the elevator installation and—if there is a large difference between the weight of the elevator car and the weight of the counterweight—possibly to uncontrolled movement of the elevator car, which has to be stopped by its safety brake. However, the satisfactory function of the safety brake or the braking deceleration of the brake shoes thereof on the guide rail, in turn, can also only be ensured when the brake shoes or the guide rail are not moistened with (soap-containing) extinguishing water.

All these requirements make it necessary for the extinguishing water to be drained off and/or intercepted in a controlled manner. The extinguishing water normally penetrates into the elevator shaft via the doors of the latter. International publication WO A1 98/22381 discloses an elevator installation having a drainage system on the shaft doors and flow barriers interengaging with a form fit on each shaft door. The attempt is thus made to keep the elevator shaft free of extinguishing water over its entire height from the outset. The disadvantage with this solution, however, is that high costs are involved in order to equip each floor with corresponding drain pipes and said flow barriers beforehand.

SUMMARY

It is an object of the present invention to provide at least one alternative solution for protecting—in particular the supporting and driving means of the elevator installation—against the extinguishing water penetrating into the shaft, while avoiding, to the greatest extent, the disadvantage cited above.

This object is achieved, in the first instance, by a drainage system being arranged on the elevator car rather than on the individual shaft doors.

This basic inventive concept is derived from the finding that the extinguishing water, rather than having to be kept away, in principle, from the elevator shaft, can also flow off in a controlled and/or deflected manner. It has been observed that a main cause of the supporting and driving means becoming wet is the splashing or spraying of the extinguishing water as it comes into contact with the roof of the elevator car.

The invention relates to a drainage system in an elevator installation having at least one elevator car with an upper edge running more or less parallel to a horizontal, wherein a drainage panel on the upper edge of the elevator car is arranged at at least one angle of inclination to the horizontal, and therefore extinguishing water which falls onto the elevator car is directed, at least in part, from the drainage panel toward the upper edge. The terms "horizontal" and "vertical" are used herein to refer directions in which various surfaces extend relative to the orientation of the elevator car.

A basic variant of a drainage system for extinguishing water according to the invention thus provides a car roof having a panel arranged obliquely, or as a slanting plane, over the cross section of the elevator car. Extinguishing water coming into contact with this oblique panel is thus fed, in principle, just to a lateral upper edge of the—usually mostly cuboidal—basic structure of the elevator car and drained off along a more or less vertical side surface of the cuboidal basic structure of the elevator car, said side surface adjoining said lateral upper edge. In this way, the extinguishing water is thus kept away from that side, or those sides, of the basic car structure on which, depending on how the elevator car is suspended, the supporting and driving means is or are located. The present application, however, is not restricted to cuboidal basic elevator-car structures; inclined drainage panels and draining side surfaces adjoining the same can also be arranged on cylindrical or prism-shaped basic structures—with three or more edges.

A first variant of the above-described basic variant of a drainage system for extinguishing water in the form of a panel arranged obliquely over the cross section of the roof of the elevator car provides an adjustable roller-shutter structure instead of a rigid and fixed panel. This roller-shutter structure can preferably be displaced by a motor and/or is biased by a spring and, furthermore, is preferably connected to a safety contact, which gives a signal for movement to commence. This variant with an adjustable or displaceable roller-shutter structure has the advantage for a fitter, or someone servicing or operating the elevator, that the roof of the elevator car and technical equipment located there, and a hatch which may be located in the roof of the elevator car, are more easily accessible.

The oblique drainage panel or the roller-shutter structure may be of planar configuration, but preferably open out into a gutter, which preferably in turn runs obliquely in relation to the horizontal and by means of which extinguishing water collected by the drainage panel or the roller-shutter structure is fed to a flow-off means at just one corner of the elevator car. The flow-off means here may still be arranged in the vicinity of the upper edge of the basic structure of the elevator car, but it may prove advantageous for the gutter and the flow-off means to be arranged such that the extinguishing water collected flows off on the underside of the basic structure of the elevator car. It is also conceivable to have variants of the collecting gutter by means of which the extinguishing water collected is fed to two, three or even four flow-off means each at a corner of the elevator car, which may prove advantageous, in particular, for managing large quantities of extinguishing water.

As a further option, the flow-off means—whether via one, two, three or all four or more corners of the basic structure of the elevator car—may be configured as a flexible hose which moves along with the elevator car. It is also possible for a simple cable, along which the extinguishing water collected flows down, to provide a solution for avoiding splashing and spraying extinguishing water in the elevator shaft.

A second variant of the basic variant with a rigid panel provides for the panel to be divided, for example more or less centrally, or also in an offset manner, into two or more surfaces which slope down to the side. The extinguishing water coming into contact therewith is thus drained off, for example, to two corners of the basic car structure.

The same drainage principle can be realized for the variant with adjustable roller-shutter structure by two or more roller-shutter structures being arranged not just obliquely in relation to an upper edge of the basic car structure, but, at the same time, also such that they slope down to the side.

The shaft wall which is located opposite the side of the car along which drainage takes place, or the corners of the car at which drainage takes place, preferably has, for its part, an intercepting and drainage system which corresponds to the elevator-car drainage system according to the invention. This intercepting and drainage system belonging to the shaft can preferably be arranged for combination with the elevator-car drainage system and is distinguished by open intercepting devices, which are arranged preferably in the corners of the elevator shaft as open intercepting profiles, and by open intercepting panels, which are arranged on at least one shaft wall, and open drainage panels, which are spaced apart from one another over the height of the elevator shaft. Via the resulting interspaces between these open intercepting devices in the form of open intercepting profiles, open intercepting panels and open drainage panels, or via similarly open receiving openings of the same, it is possible to feed both extinguishing water which is collected on the roof of the elevator car and extinguishing water which enters the elevator shaft through the shaft doors.

The above-described obliquely arranged drainage surfaces of the car roof are preferably equipped, in addition, with a peripheral rebate and/or a more or less vertical connecting panel or a more or less vertical metal connecting sheet. The above-described drainage panels are preferably produced from sheet metal, although plastics-material panels are also possible.

The obliqueness of the drainage surfaces constitutes, in principle, a compromise between an overly high roof construction of the elevator car and the obliqueness being so shallow that the extinguishing water coming into contact with the drainage surfaces would still be able to splash or spray. The obliqueness is thus preferably 45 degrees, but may, in principle, be in a range from 20 to 70 degrees in relation to the horizontal.

The inclined drainage panel may be inclined, in principle, in relation to that shaft wall in which the shaft doors are arranged or else also in relation to the opposite shaft wall, or approximately from an elevated center in relation to both sides—as it were as a roof ridge with two drainage surfaces; but not in relation to the sides of the elevator car, or to those shaft walls, past which the supporting and driving means is or are guided. In the case of the supporting and driving means being guided along just one side of the elevator car, or along just one shaft wall, a third possible direction of inclination, in principle, is also that side which is located opposite the supporting and driving means, regardless of whether this is the side with the shaft doors or not.

It is also possible for the inclined drainage panel to cover the entire cross section of the roof of the elevator car, or also just a sub-surface thereof, extending only just behind the supporting and driving means. That is to say, if the supporting and driving means passes or pass beneath the elevator car, for example, in the center, the drainage panel extends from the lower flow-off edge to a higher edge arranged on the far side of the center. The remaining interspace here between the higher edge and an elevator-car upper edge located opposite the flow-off edge can remain free or be covered in a horizontally planar manner.

It is also possible for the oblique drainage panel to be configured with two or more different angles of inclination. It is thus possible, for example, for a first drainage surface, with an angle of inclination of, for example, more or less 30 degrees, to merge into a second drainage surface of, for example, more or less 60 degrees.

An elevator car configured according to the invention may optionally be equipped, in addition, with one or more vertical drainage panels in splashguard form, these drainage panels being arranged on those side surfaces of the basic car structure past which the supporting and driving means is or are guided. These vertically arranged drainage panels shield the supporting and driving means against extinguishing water and can extend over the entire height of the elevator car or even beyond this, both on the upper side, and on the underside, of the elevator car.

These vertically arranged drainage panels can optionally run along in a slot provided for this purpose in the respectively opposite shaft wall, and therefore it is no longer possible for any extinguishing water to penetrate through even between any gap between the vertical drainage panel and the opposite shaft wall.

The edges of the obliquely arranged drainage surfaces from which the extinguishing water flows off are preferably equipped with a lip which is, again, of oblique or curved configuration. This prevents extinguishing water which flows off from the edge from being deflected in the direction of the center of the shaft on account of adhesion to the drainage surface. As a further option, the drainage surfaces may be coated with adhesion-reducing substances or paints, for example with a lotus-effect paint, which forms a highly water-repellent surface. It may further be advantageous for the edges between the drainage surface and/or the drainage surfaces and the side surface of the basic elevator-car structure and/or of the gutter or gutters to be rounded.

A further variant of an elevator car or of an elevator installation provides a collecting device which collects the extinguishing water and is disengaged or opened as it moves past a triggering lever. This has the advantage that the extinguishing water, firstly, in some circumstances, drips not just in an uncontrolled manner from the side surface or out of the flow-off means, but, secondly, is discharged in a directionally better controllable surge at a desirable location. This can take place at a location of the elevator shaft which is designed specifically for receiving and channeling away the surge of extinguishing water. The collecting device is preferably equipped with a sensor which indicates when the collecting device is full and movement past the triggering lever has to take place.

The individual features according to the invention described above can be combined with one another to form an elevator car or an elevator installation; it is therefore possible to combine, for example, a rigid oblique drainage panel or a plurality of rigid oblique drainage panels with the lip and/or the collecting device and/or the flow-off means, in one and/or more parts, and the vertical drainage panels and this all, in turn, with the roller-shutter structure or the roller-shutter structures.

A drainage system for extinguishing water according to the invention, whether in the form of the above-described elevator-car drainage system, and variants thereof, alone or in combination with the corresponding drainage system for extinguishing water belonging to the shaft, is suitable both for elevator installations having a machinery compartment and for elevator installations without a machinery compartment. Existing elevator installations can advantageously be retrofitted with a drainage system for extinguishing water according to the invention.

An elevator car equipped according to the invention and an elevator installation according to the invention provide the following advantages:

- Extinguishing water penetrating into the elevator shaft through the shaft doors is kept away from the supporting and driving means.
- The elevator car serves as an element which regulates the controlled flow-off of the extinguishing water in the elevator shaft as a whole.
- The elevator car is streamlined, which provides for optimized displacement of air in the elevator shaft and for smoother and more stable running of the elevator car. At high speeds, this is also manifested in the driving forces being reduced. In some circumstances a similar design is advantageous not just on the upper side, but also on the underside of the elevator car.
- The amount of space required for an elevator installation is reduced, and assembly is simplified, in relation to an elevator installation as disclosed by the prior art and, for example, the international publication cited.

DESCRIPTION OF THE DRAWINGS

The invention will be explained in more detail, symbolically and by way of example, with reference to figures. An overall description of the figures, taken together, is given. Like reference signs denote like components; reference signs with different indices indicate functionally identical or similar components.

In the figures.

DETAILED DESCRIPTION

Figure 1:
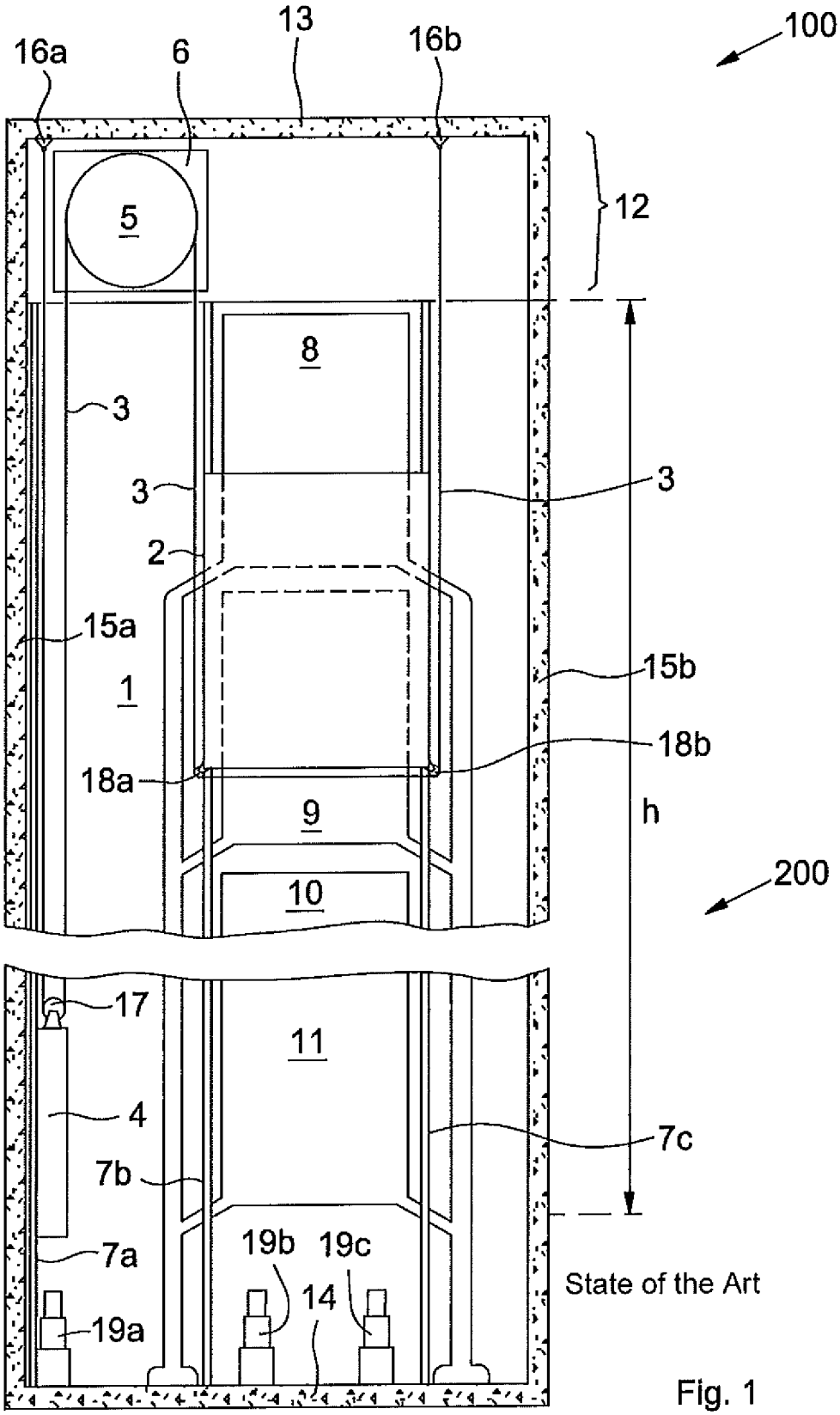
FIG. 1 shows a schematic illustration of an example of an elevator installation having an elevator car according to the prior art.

FIG. 1 shows an elevator installation 100 as is known from the prior art, for example with 2:1 suspension illustrated. An elevator car 2 is arranged in a displaceable manner in an elevator shaft 1 and is connected to a displaceable counterweight 4 via a supporting and driving means 3. The supporting and driving means 3 is driven, during operation, by means of a driving pulley 5 of a drive unit 6, these being arranged in a machinery compartment 12 in the uppermost region of the elevator shaft 1. The elevator car 2 and the counterweight 4 are guided by means of guide rails 7*a* and 7*b* and 7*c* extending over the height of the shaft.

Over a conveying height h, the elevator car 2 can serve an uppermost floor door 8, further floor doors 9 and 10 and a lowermost floor door 11. The elevator shaft 1 is formed from shaft side walls 15*a* and 15*b*, a shaft ceiling 13 and a shaft floor 14, on which are arranged a shaft-floor buffer 19*a* for the counterweight 4 and two shaft-floor buffers 19*b* and 19*c* for the elevator car 2.

The supporting and driving means 3 is fastened at a fixed-location fastening point or supporting-means-fixing point 16*a* on the shaft ceiling 13 and is guided, parallel to the shaft side wall 15*a*, to a supporting roller 17 for the counterweight 4. From here, in turn, the supporting and driving means 3 is guided over the driving pulley 5 to a first deflecting or supporting roller 18*a* and, passing beneath the elevator car 2, to a second deflecting or supporting roller 18*b* and to a second fixed-location fastening point for a supporting-means-fixing point 16*b* on the shaft ceiling 13.

FIG. 1 also shows, symbolically, a closed drainage system 200 for extinguishing water which uses closed pipelines and pipe connections to channel away extinguishing water into the shaft floor 14 from each individual floor and/or each individual shaft door 8-11.

Figure 2:
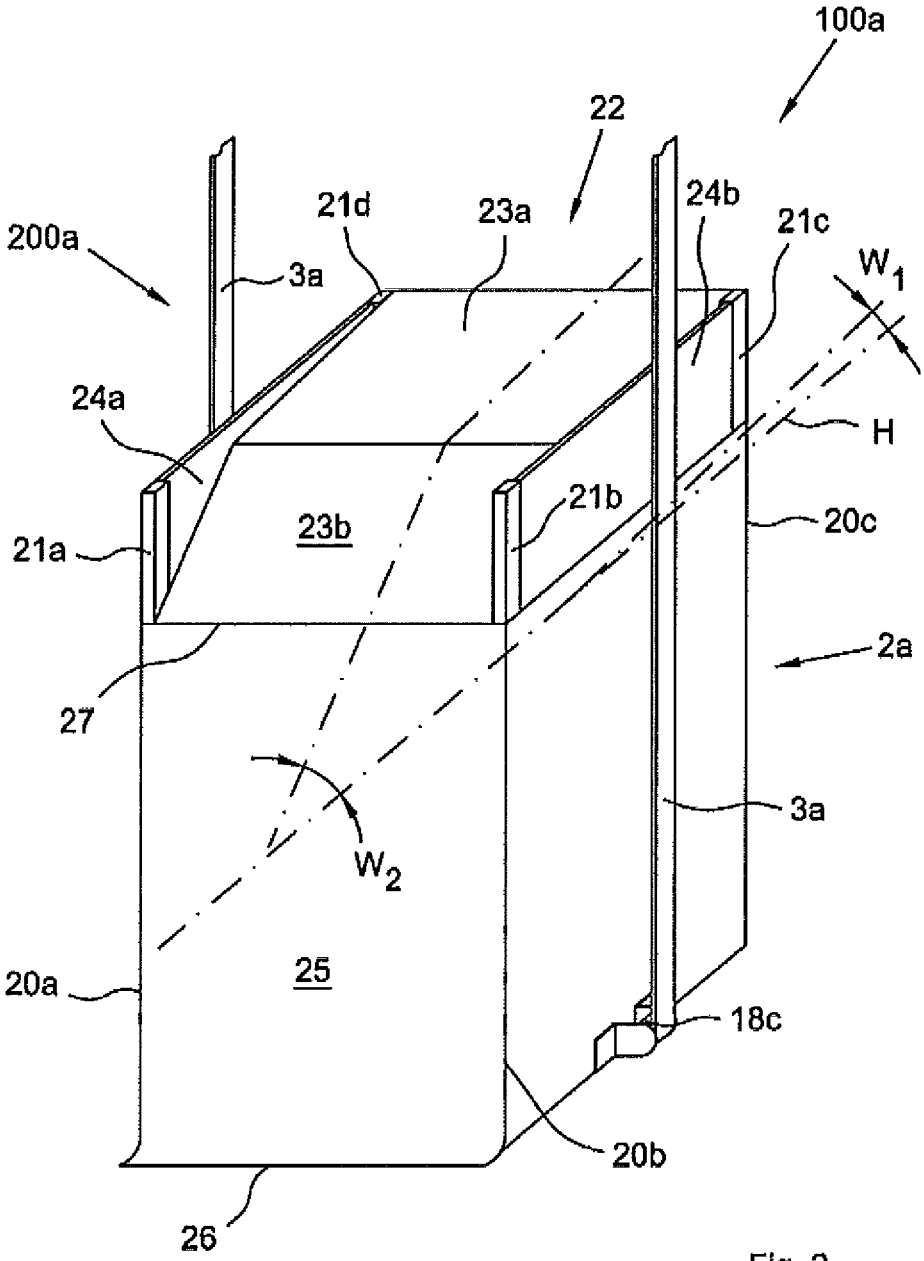
FIG. 2 shows a schematic illustration of a first variant of an elevator car according to the invention and/or of an elevator installation.

FIG. 2 shows, schematically, an example of an elevator car 2*a*, which is a constituent part of an example of an elevator installation 100*a*. The elevator car 2*a* is supported by a supporting and driving means 3*a* which is guided by deflecting or supporting rollers 18*c* and 18*d*, of which only the deflecting or supporting roller 18*c* is visible in the perspective illustration shown. The cuboidal basic structure of the elevator car 2*a* has four fastening struts 21*a*-21*d* in extension of four more or less vertical corner edges 20*a*-20*d* (of which, on account of the perspective view, only the corner edges 20*a*-20*c* are visible).

A rigid drainage panel 22 is fastened on these four fastening struts 21*a*-21*d*, flush in relation to an upper edge 27 of the elevator car 2*a*, and forms a first drainage surface 23*a*, having an approximate angle of inclination $W_1$ of 30 degrees to a horizontal H, and a second drainage surface 23*b*, having an angle of inclination $W_2$ of more or less 60 degrees to the horizontal H. A more or less vertical connecting panel 24*a* or 24*b* is connected to the drainage surfaces 23*a* and 23*b* and to the fastening struts 21*a*, 21*d* and 21*b*, 21*c*, respectively.

Extinguishing water which comes into contact with the drainage surfaces 23*a* and 23*b* is thus collected and will flow down a side surface 25 of the elevator car 2*a* and be deflected by an optional lip 26. The drainage surfaces 23*a* and 23*b*, the connecting panels 24*a* and 24*b*, the side surface 25 and the lip 26 thus form a first elevator-car drainage system 200*a* according to the invention.

Figure 3:
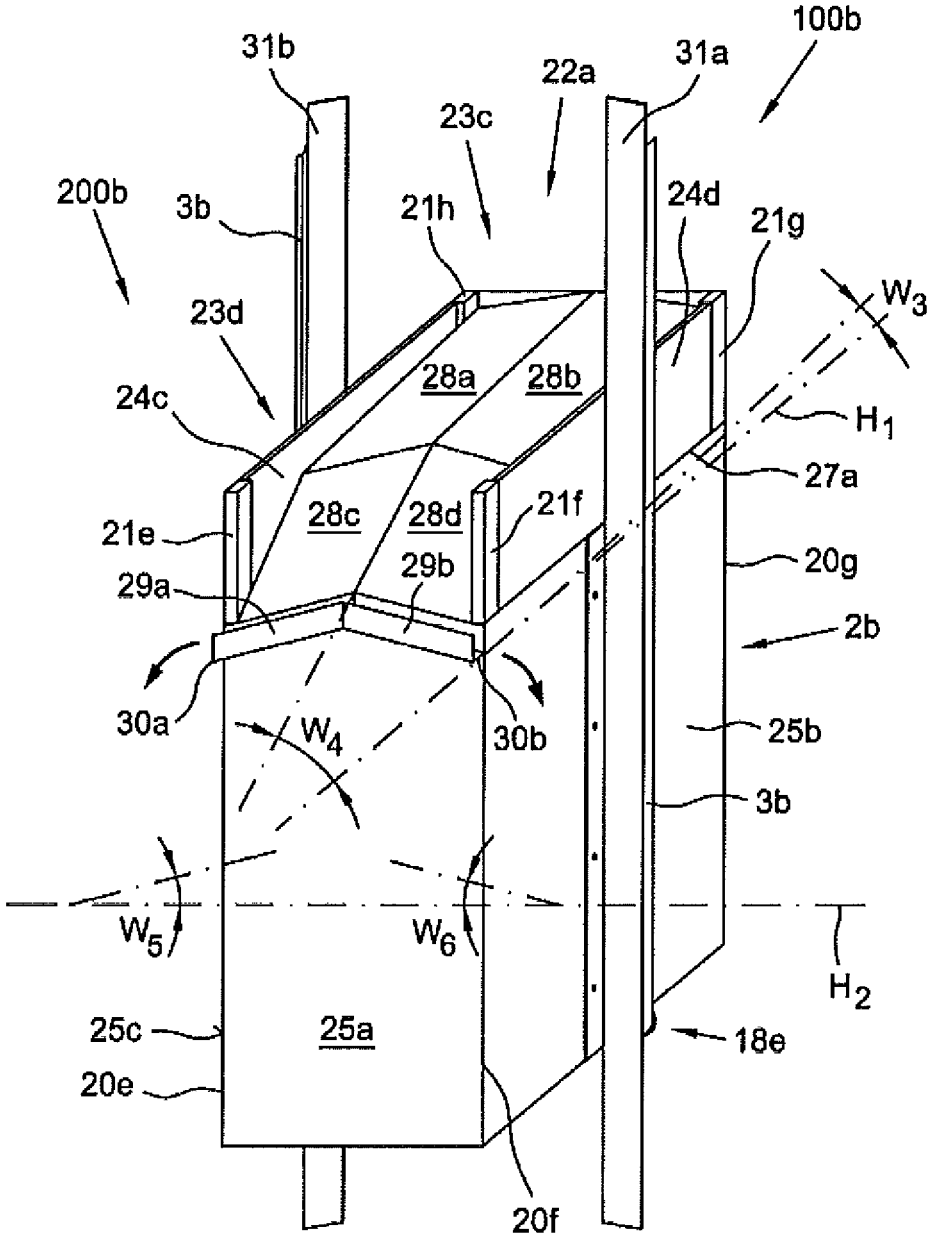
FIG. 3 shows a schematic illustration of a second variant of an elevator car and/or of an elevator installation.

FIG. 3 illustrates, schematically a variant of an elevator car 2*b* and/or of an elevator installation 100*b*. The elevator car 2*b*, supported by a supporting and driving means 3*b* in a visible deflecting or supporting roller 18*e* and in a concealed deflecting or supporting roller 18*f*, has a side surface 25*a* between a corner edge 20*e* and a further corner edge 20*f*, a further side surface 25*b* between the corner edge 20*f* and a further corner edge 20*g*, and a further side surface 25*c* between the corner edge 20*e* and a corner edge 20*h*, which is not visible in the perspective view illustrated. The side surfaces 25*a*, 25*b* and 25*c* form an upper edge 27*a* of the elevator car 2*b*. Fastening struts 21*e*, 21*h* are arranged on this upper edge 27*a*, in extension of the corner edges 20*e*-20*h*, and a drainage panel 22*a* and more or less vertical connecting panels 24*c* and 24*d* are fastened on said fastening struts.

In a manner analogous to the drainage panel 22 from FIG. 2, the drainage panel 22*a* is formed from two drainage surfaces 23*c* and 23*d*, of which the drainage surface 23*c* is inclined by an angle of inclination $W_3$ of more or less 30 degrees to a first horizontal $H_1$ and the drainage surface 23*d* is inclined by an angle of inclination $W_4$ of approximately 60 degrees to said first horizontal $H_1$. The drainage surfaces 23*c* and 23*d*, in turn, each form two sub-surfaces 28*a*, 28*b* and 28*c*, 28*d*, which are inclined in a mirror-inverted manner, and in the direction of the upper edge 27*a*, by a respective angle of inclination $W_5$ and $W_6$ of more or less 30 degrees to a second horizontal $H_2$.

Two gutters 29*a* and 29*b*, each with a flow-off means or discharge means 30*a* and 30*b*, respectively, are arranged on the side surface 25*a*, flush with the sub-surfaces 28*c* and 28*d*. This means that the extinguishing water is collected on the roof of the elevator car 2*b*, channeled away to the side surfaces 25*a*-25*c*, collected in the gutters 29*a* and 29*b* and discharged via the flow-off means or discharge means 30*a* and 30*b* at the corner edges 20*e* and 20*f* of the elevator car 2*b*.

For further protection of the supporting and driving means 3*b*, a vertical drainage panel or splash guard 31*a*, 31*b* is arranged, in the form of an angled profile, on each of the side surfaces 25*b* and 25*c*, respectively.

The drainage panel 22*a* illustrated, the more or less vertical connecting panels 24*c* and 24*d*, the gutters 29*a* and 29*b* and the vertical drainage panels or splashguard 31*a* and 31*b* form a second variant according to the invention of a drainage system 200*b* on the elevator car 2*b* and/or in the elevator installation 100*b*.

As an optional variant, it is possible for the flow-off means or discharge means 30*a* and 30*b* to be arranged by means of two connecting tubes on the lower edge of the elevator car 2*b* and, as a further option, for the extinguishing water which collects on the vertical drainage panels or splashguard 31*a* and 31*b* to be fed to these discharge means 30*a* and 30*b* or flow-off means arranged on the lower edge.

Figure 4:
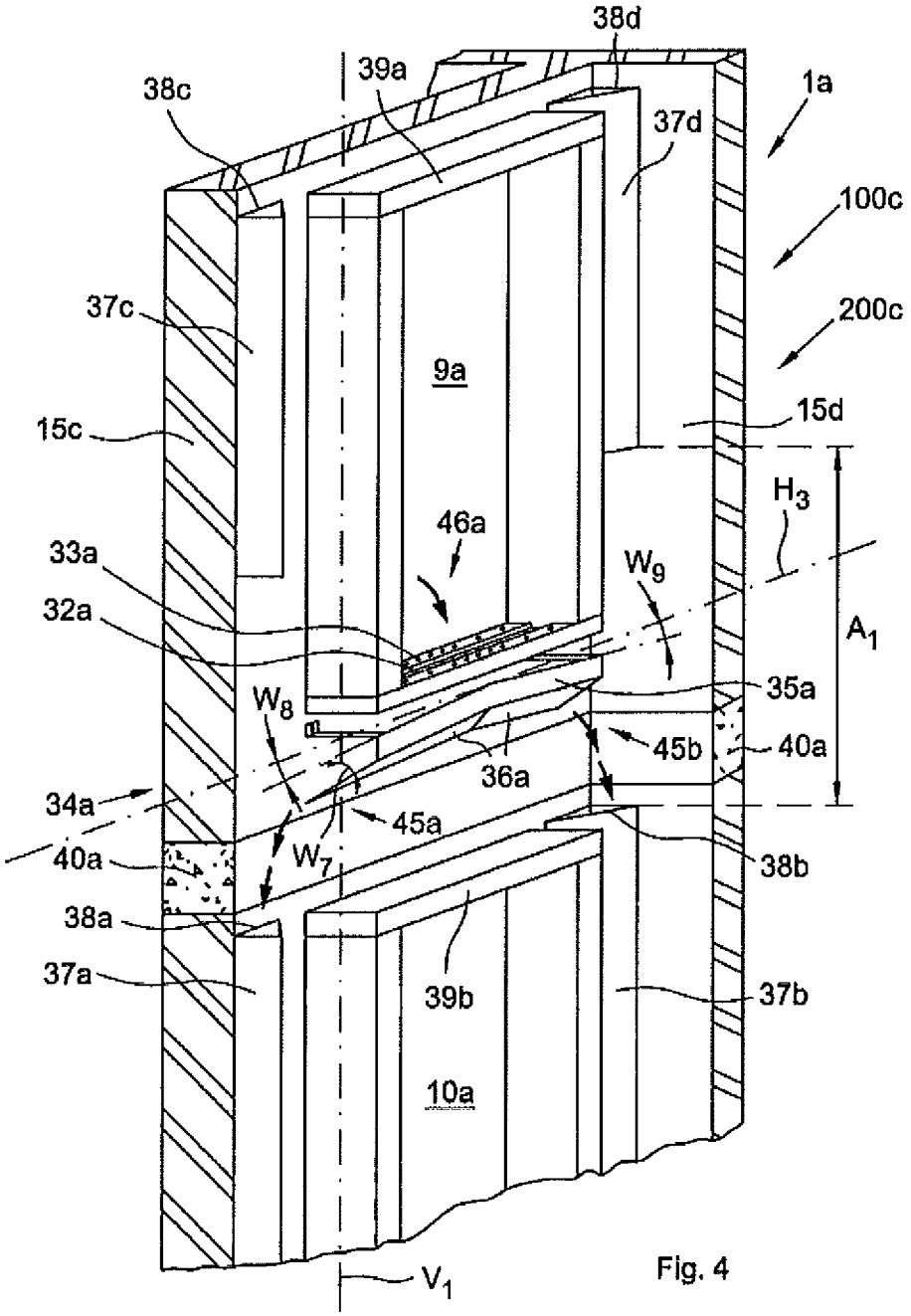
FIG. 4 shows a schematic illustration of a first variant of a drainage system for extinguishing water which belongs to the shaft and can optionally be combined with the elevator-car drainage systems shown in FIGS. 2 and 3.

FIG. 4 shows, schematically, an example of an elevator shaft 1*a*, which is a constituent part of an example of an elevator installation 100*c*. Of the side walls of the elevator shaft 1*a*, shaft side walls 15*c* and 15*d*, which are at more or less right angles to one another, are illustrated in the figure. The floors are indicated by an intermediate floor or screed floor 40*a*, and each have a floor door or shaft door 9*a* and 10*a*. A respective door lintel 39*a*, 39*b* is located on the upper side of the shaft doors 9*a* and 10*a*. Located on the underside of the shaft door 9*a* is a shaft-door sill 32*a*, which comprises channel crosspieces and has through-openings or apertures or bores 33*a*, preferably both in the channel crosspieces and in the grooves located therebetween. The bores 33*a* here are in a pattern which is narrower in the center of the shaft-door sill 32*a* and widens in the direction of the sides.

Beneath the shaft-door sill 32*a*, the shaft side wall 15*c* has arranged on it an intercepting panel 34*a*, which forms a more or less vertical sub-surface 35*a*—that is to say one which is parallel to a vertical $V_1$—and a sub-surface 36*a* which is inclined at an angle of inclination $W_7$ to the vertical $V_1$. At least the inclined sub-surface 36*a*, or also, in addition, the more or less vertical sub-surface 35*a*, forms, in a mirror-inverted manner, from approximately the center of the intercepting panel 34*a*, a respective angle of inclination $W_8$ or $W_9$ to a horizontal $H_3$.

Accordingly, as indicated by arrows, extinguishing water 46*a* flows through the shaft-door sill 32*a*, is collected by the intercepting panel 34*a* and fed laterally, in each case through outflow openings 45*a* and 45*b*, into receiving openings 38*a* and 38*b* of a respective intercepting profile 37*a*, 37*b*. In order to show clearly an open drainage system 200*c* for extinguishing water belonging to the shaft, further intercepting profiles 37*c* and 37*d*, each with respective receiving openings 38*c* and 38*d*, are arranged at a distance $A_1$ and serve for receiving the extinguishing water which would come out of a shaft door above the shaft door 9*a*. The distance $A_1$, on the one hand, is decisive for reliable transfer of extinguishing water from the higher intercepting profiles 37*c* and 37*d* into the lower intercepting profiles 37*a* and 37*b* and, on the other hand, is decisive for extinguishing water being reliably received from the outflow openings 45*a* and 45*b*, but also for extinguishing water which is intercepted on the roof of the elevator car 2*a* and 2*b* from FIGS. 2 and 3 being reliably received.

Figure 5:
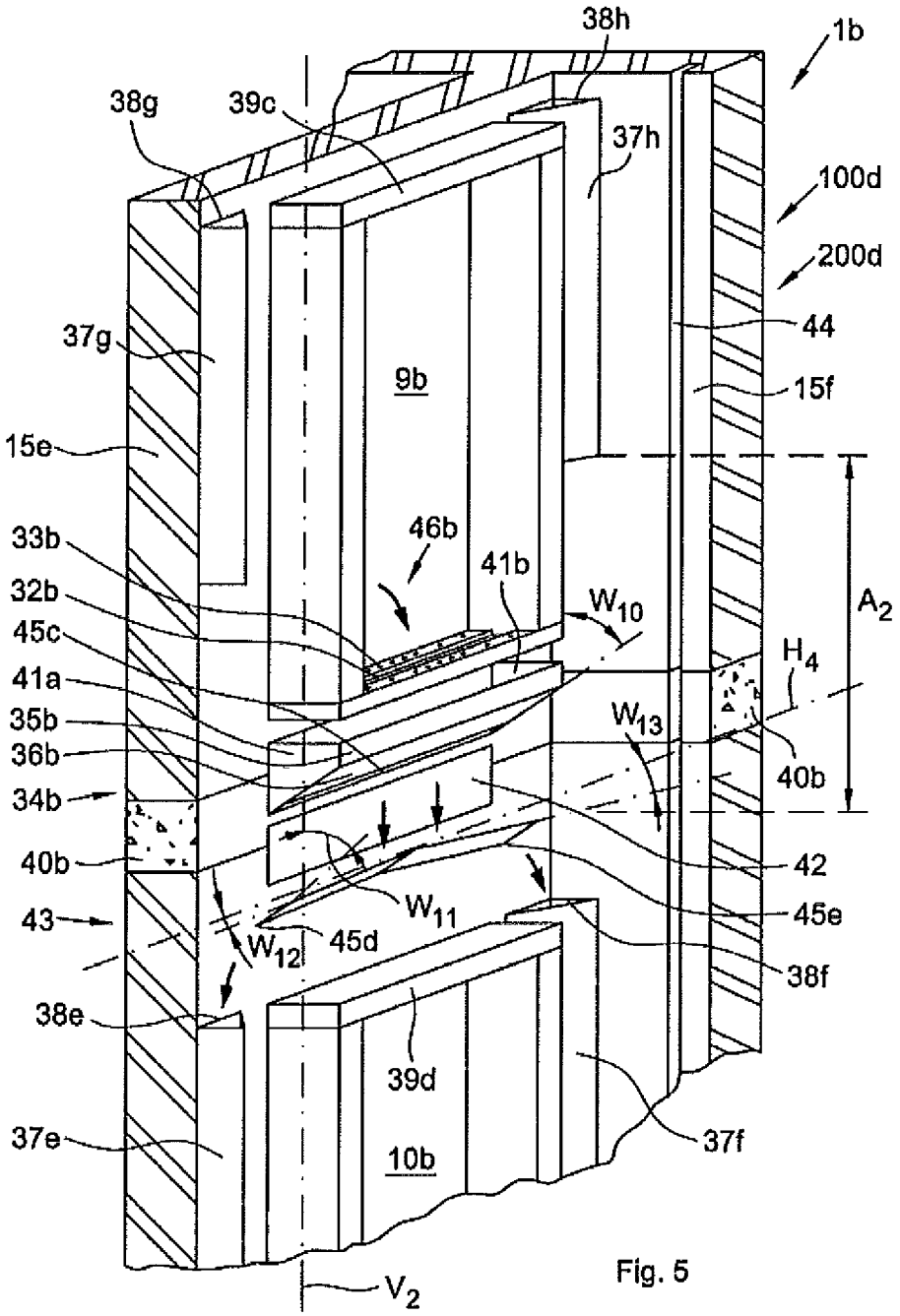
FIG. 5 shows a schematic illustration of a second variant of a drainage system for extinguishing water which belongs to the shaft and can optionally be combined with the elevator car drainage systems shown in FIGS. 2 and 3.

FIG. 5 illustrates, schematically, a variant of an elevator shaft 1*b* and/or of an elevator installation 100*d*. In a manner analogous to FIG. 4, a shaft door 9*b* with a door lintel 39*c* and a shaft-door sill 32*b*, with through-openings or apertures or bores 33*b*, and a further shaft door 10*b* with a door lintel 39*d* are illustrated in a shaft side wall 15*e*. An intermediate floor 40*b* passes through both the shaft side wall 15*e* and a further shaft side wall 15*f*, which is ranged more or less at right angles.

Beneath the shaft-door sill 32*b*, an intercepting panel 34*b* is arranged on the shaft side wall 15*e*. This intercepting panel 34*b* is open at the top and has a more or less vertical sub-surface 35*b* and an inclined sub-surface 36*b*, which adjoins the surface 35*b* and is at an angle of inclination $W_{10}$ to a vertical $V_2$. The intercepting panel 34*b* also has side surfaces 41*a* and 41*b*. Beneath the intercepting panel 34*b*, a flow-off panel 42 is arranged likewise on the shaft side wall 15*e*, and this flow-off panel improves the flow-off behavior of extinguishing water 46*b* which has penetrated through the shaft-door sill 32*b* and is intercepted by the intercepting panel 34*b* and passed on, on account of the laterally bounding side surfaces 41*a* and 41*b*, exclusively centrally through a gap-like outflow opening 45*c* between the inclined sub-surface 36*b* and the shaft side wall 15*e*.

It is also possible for the flow-off panel 42 to be larger than illustrated and/or to be connected to the inclined sub-surface 36*b* and a drainage panel 43 arranged beneath the flow-off panel 42. Said drainage panel 43 is at an angle of inclination $W_{11}$ to the vertical $V_2$ and, in addition, is inclined downward in a mirror-inverted manner, from approximately its center toward the sides in each case, by an angle of inclination $W_{12}$, $W_{13}$ to a horizontal $H_4$, and therefore the extinguishing water 46*b* flowing off from the flow-off panel 42 is directed thereby, via respective outflow openings 45*d* and 45*e*, into a receiving opening 38*e* of an intercepting profile 37*e* and a receiving opening 38*f* of an intercepting profile 37*f*.

Once more, in order to show clearly an open drainage system 200*d* for extinguishing water belonging to the shaft, it is illustrated that further intercepting profiles 37*g* and 37*h*, each with respective receiving openings 38*g* and 38*h*, are arranged at a distance $A_2$ above the intercepting profiles 37*e* and 37*f* in the corners of the elevator shaft 1*b*.

Furthermore, the elevator shaft 1*b* has, in the shaft side wall 15*f*, a vertically running slot 44, in which the drainage panel 31*a* or 31*b* from FIG. 3, said drainage panel being arranged on the elevator car 2*b*, can run along, as a splashguard, in a recessed manner.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A drainage system in an elevator installation having an elevator car movable in an elevator shaft, the elevator car having an upper edge extending generally parallel to a first horizontal direction, comprising:

a drainage panel arranged on the upper edge of the elevator car at at least one angle of inclination relative to the first horizontal direction, the drainage panel covering an entire roof of the elevator car, wherein drainage surfaces of the drainage panel are bounded by connecting panels arranged generally perpendicular to the first horizontal direction; and the drainage panel being inclined in relation to the first horizontal direction, wherein extinguishing water which falls onto the elevator car is directed from the drainage panel to the upper edge and is drained off along a vertical side of the elevator car adjoining the upper edge toward a shaft wall of the elevator shaft in which shaft doors are arranged, the drainage panel being configured to keep the extinguishing water away from at least one other vertical side of the elevator car.

2. The drainage system according to claim 1 wherein the drainage panel has at least two drainage surfaces with different angles of inclination to the first horizontal direction.

3. The drainage system according to claim 2 wherein the at least two drainage surfaces include at least one subsurface at an angle of inclination to a second horizontal direction.

4. The drainage system according to claim 1 wherein at least one gutter with a flow-off means is arranged on a side surface of the elevator car.

5. The drainage system according to claim 1 wherein a lip is arranged on a side surface of the elevator car.

6. The drainage system according to claim 1 wherein other drainage panels are arranged generally perpendicular to the first horizontal direction as a splashguard for a supporting and driving means of the elevator car on side surfaces of the elevator car.

7. The drainage system according to claim 6 wherein the other drainage panels run along in a slot in side walls of the elevator shaft.

8. An elevator installation having at least one drainage system according to claim 1.

9. The drainage system according to claim 1 wherein the drainage panel is configured to keep extinguishing water penetrating the elevator shaft through the shaft doors away from a supporting and driving means of the elevator car.

10. A method of draining extinguishing water in an elevator installation using a drainage system on an elevator car comprising the following steps:

a) intercepting the extinguishing water with a drainage panel arranged on an upper edge of the elevator car at at least one angle of inclination relative to a first horizontal direction, the drainage panel covering an entire roof of the elevator car, wherein drainage surfaces of the drainage panel are bounded by connecting panels arranged generally perpendicular to the first horizontal direction;

b) passing on the extinguishing water on the drainage panel to the upper edge; and c) discharging the extinguishing water from the upper edge of the elevator car along a vertical side of the elevator car adjoining the upper edge into an elevator shaft toward a shaft wall of the elevator shaft in which shaft doors are located while the drainage panel keeps the extinguishing water away from at least one other vertical side of the elevator car.

11. The method according to claim 10 wherein the extinguishing water is discharged from the elevator car into the elevator shaft via a lip on the elevator car or via at least one gutter on the elevator car.

12. The method according to claim 10 wherein the drainage panel is configured to keep extinguishing water penetrating the elevator shaft through shaft doors away from a supporting and driving means of the elevator car.

13. A drainage system in an elevator installation having an elevator car movable in an elevator shaft, the elevator car having an upper edge extending generally parallel to a first horizontal direction, comprising:

a drainage panel arranged on the upper edge of the elevator car at at least one angle of inclination relative to the first horizontal direction, wherein the drainage panel has at least two drainage surfaces with different angles of inclination to the first horizontal direction, wherein the at least two drainage surfaces of the drainage panel are bounded by connecting panels arranged generally perpendicular to the first horizontal direction; and the drainage panel being inclined in relation to the first horizontal direction, wherein extinguishing water which falls onto the elevator car is directed from the drainage panel to the upper edge and is drained off along a vertical side of the elevator car adjoining the upper edge toward a shaft wall of the elevator shaft in which shaft doors are arranged, the drainage panel being configured to keep the extinguishing water away from at least one other vertical side of the elevator car.

14. The drainage system according to claim 13 wherein the drainage panel is configured to keep extinguishing water penetrating the elevator shaft through the shaft doors away from a supporting and driving means of the elevator car.

* * * * *